United States Patent [19]

Whitman, Sr. et al.

[11] 4,291,452

[45] Sep. 29, 1981

[54] TENSION RELIEVING AND BOWSTRING REPLACING DEVICE FOR COMPOUND BOW

[75] Inventors: Archie E. Whitman, Sr., Seal Rock; Donald D. W. Lathrops, Springfield, both of Oreg.

[73] Assignee: Whitlath Co., Newport, Oreg.

[21] Appl. No.: 135,170

[22] Filed: Mar. 28, 1980

Related U.S. Application Data

[63] Continuation-in-part of Ser. No. 73,714, Sep. 10, 1979, abandoned.

[51] Int. Cl.[3] ..... B23P 19/02

[52] U.S. Cl. ..... 29/235; 124/23 R; 254/255

[58] Field of Search ..... 29/235; 254/250, 254, 254/255, 251, 256, 253, 260; 24/271, 71 ST, 71 TD, 71 T, 71 TI, 71 A; 124/23, 24, 86, 90, 80

[56] References Cited

U.S. PATENT DOCUMENTS

| | | | |
|---|---|---|---|
| 257,263 | 5/1882 | Wood | 24/71 TD |
| 1,140,115 | 5/1915 | Carson | 254/255 |
| 1,518,769 | 12/1924 | Brunk | 254/255 |
| 4,032,111 | 6/1977 | Garrett | 254/256 |
| 4,074,409 | 2/1978 | Smith | 124/90 |

*Primary Examiner*—James L. Jones, Jr.
*Attorney, Agent, or Firm*—Chernoff & Vilhauer

[57] ABSTRACT

A device for use in replacing a bowstring of a compound bow and for storing a compound bow in a partially de-tensioned condition without the need to retune the compound bow upon replacement of the bowstring. A connector including a socket for holding a bowstring fastener which is fixed on the end of one of the cables, and a retainer for maintaining the connector in engagement with the cable, are located at each end of elongate linking means including a lever-operated tensioner. The device is installed on the cables of a compound bow while the bowstring is installed, and the lever-operated tensioner is used to slacken the bowstring, allowing its replacement or removal. With the bowstring removed from the fastener the tensioning device may be extended to reduce tension on the bow to a value below that existent when the bowstring is installed, without completely loosening the cables. A turnbuckle is provided to enable the device to be adjusted for use with compound bows having bowstrings of various lengths. A second embodiment of the device includes a plurality of attachment points for the turnbuckle to provide a greater range of adjustability of effective length.

10 Claims, 8 Drawing Figures

FIG. 1
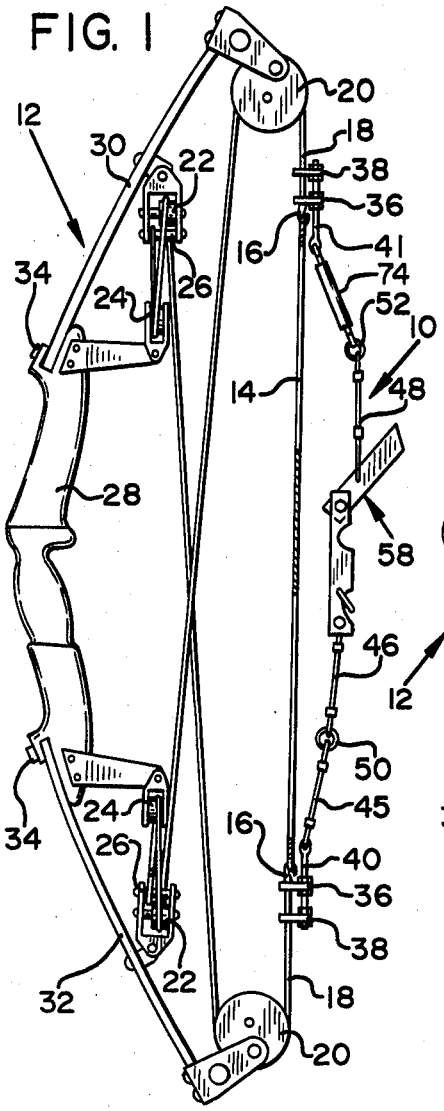
FIG. 6
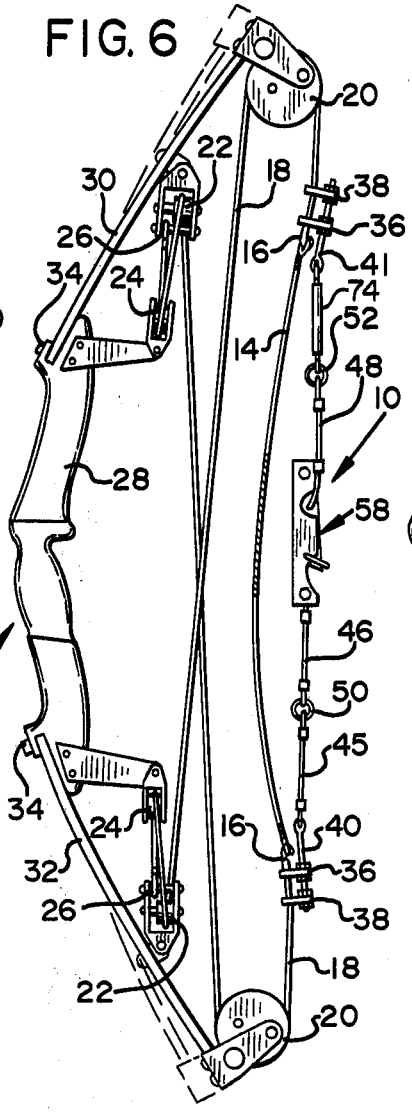
FIG. 7
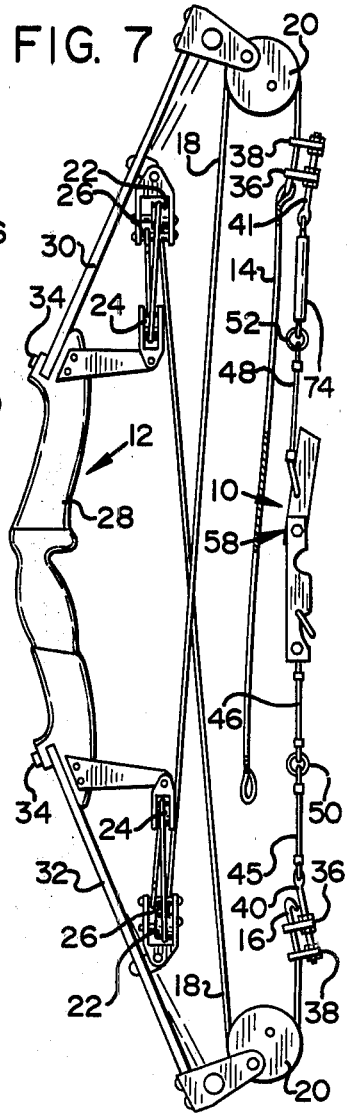
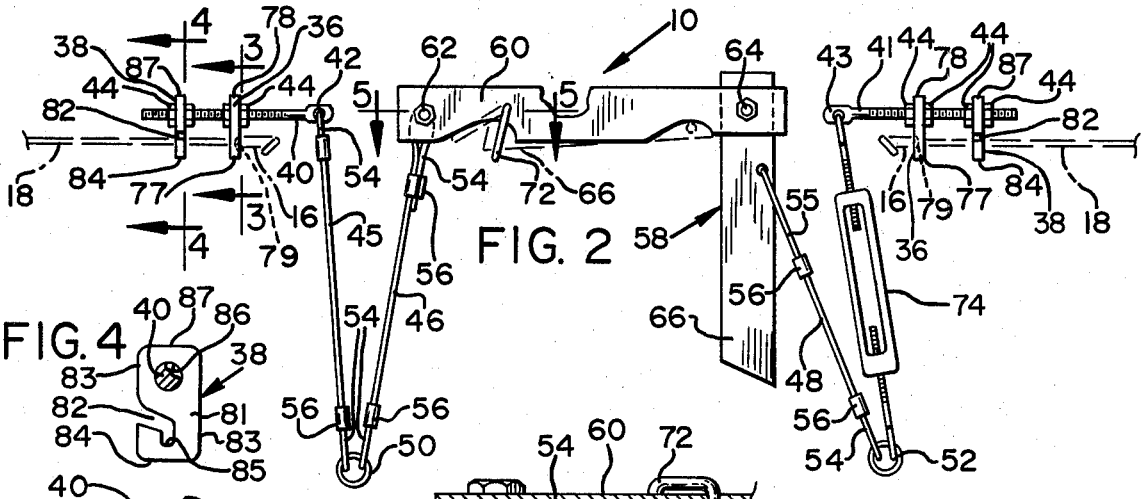
FIG. 2
FIG. 4
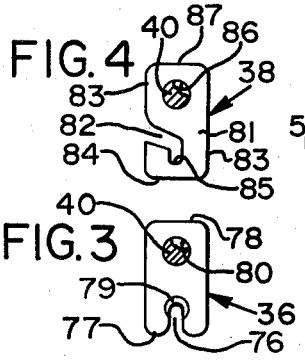
FIG. 3
FIG. 5

TENSION RELIEVING AND BOWSTRING REPLACING DEVICE FOR COMPOUND BOW

REFERENCE TO PRIOR APPLICATION

This application is a continuation-in-part of copending application Ser. No. 073,714, filed Sept. 10, 1979 now abandoned.

BACKGROUND OF THE INVENTION

The present invention relates to compound archery bows, and particularly to a device to aid in replacing a bowstring and for retaining tension in the cables of a compound bow as the bowstring is being replaced and while the compound bow is stored without a bowstring installed.

A compound bow is an archery bow such as the one disclosed in Allen U.S. Pat. No. 3,486,495. A compound bow includes cables which ride on eccentric pulleys mounted on the bow limbs, enabling such a bow to impart a greater amount of energy to an arrow than was previously possible using simple archery bows. Because of these cables and pulleys, the limbs of a compound bow flex through a smaller distance as the bow is drawn fully than do the limbs of a simple bow. However, in order to store the energy of the drawn bow, the limbs of the compound bow are much stiffer than those of a simple bow, and are very difficult to bend manually.

Optimum performance of a compound bow requires that the bow be tuned, so that the eccentric pulleys rotate in proper relationship to one another, and so that the two limbs of the bow each do the proper amount of work in propelling an arrow. Tuning the compound bow may include adjustment of the length of each of the cables, one of which is associated with each limb of the bow, by adjusting the amount of each cable which is wound upon a respective cable adjustment drum. Some compound bows also require adjustment of the positions of the limbs with respect to the central frame portion of the bow. Once a compound bow has been properly tuned, it is important to maintain some tension on the cables at all times, since relaxing tension could allow one of the cables to shift on the adjustment drum, slightly changing the effective length of that cable and disturbing the tuning of the bow.

A compound bow usually has a replaceable fiber bowstring. The bowstring is normally attached by a loop at each of its ends to a hook or other bowstring fastener which is usually swaged onto the end of one of the two cables of the compound bow. Through use, the fiber bowstring eventually becomes worn and must be replaced with a new one. So long as a new bowstring is of identical length to the old bowstring, and tension is maintained on the cables during replacement of the bowstring, no retuning of the bow is necessary upon replacement of the bowstring.

Since shooting a bow is an acquired skill, and depends upon predictable response of the bow, it is important that an archer in the field should be able to quickly and easily change bowstrings without altering the performance of the bow. It is therefore desirable for a bowstring changing device to be easily carried for use in the field by a bow hunter.

It is also desirable to store a compound bow with its bowstring tension relaxed, so that the limbs do notaquire a "set". If a compound bow is unstrung and the cables are allowed to become slack, however, the bow will need to be retuned when it is restrung.

Devices enabling replacement of a bowstring without disturbing the tuning of the bow have been disclosed in Carlson U.S. Pat. No. 4,050,137 and Smith U.S. Pat. No. 4,074,409. While both the Carlson device and the Smith device enable a bowstring of a compound bow to be replaced without necessitating retuning the compound bow, neither of these devices is particularly easy to use.

The Carlson device comprises a steel cable having a slotted tubular engagement member fixed at each end of the cable. One engagement member may be slipped over each cable of the bow while the bowstring is installed. Tension must then be taken on the cable of the Carlson device, as, for example, by drawing the cable in a fashion similar to that used to draw the bow using the bowstring, to relieve tension in the bowstring. The bowstring must then be replaced while tension is held in the cable of the bowstring changing device. Because compound bows are often very strong and stiff, it becomes awkward and difficult for one person alone to both pull the Carlson bowstring changer cable and simultaneously remove or replace the bowstring. While the Carlson device is simply constructed, its steel cable makes it bulky and cumbersome to carry in the field.

The Smith device uses a nylon cord to interconnect a pair of hooks, each resembling a pair of curved fingers with a slot therebetween, used to engage the bowstring fastener on each cable. The nylon cord is looped around a pulley fastened to one of the hooks, and a simple friction device is used to control the separation between the hooks so long as tension is maintained in the nylon cord. While the Smith device allows the user to easily replace a bowstring once sufficient tension is applied to slacken the bowstring, it is possible to inadvertently dislodge the hooks from the cables of the compound bow while applying tension to the Smith device. Additionally, the Smith device requires the user to manually pull the ends of the bow limbs toward one another, a difficult task with a strong compound bow.

What is needed, therefore, is an easily and securely installed and easily operated device for replacing the bowstring of a compound bow. Such a device should be capable of being carried easily for use in the field. It should also be usable for storing a compound bow in a partially relaxed condition with the bowstring removed, without loss of tuning of the compound bow, and without danger of the device becoming dislodged from the cables of the compound bow.

SUMMARY OF THE INVENTION

The adjustable tension-relieving and bowstring replacing device of the present invention overcomes the shortcomings and disadvantages of the prior art bowstring changers for compound bows by providing an adjustable device which is securely and easily attached to a compound bow, is easily operated, and which may be used to retain tension in the cables of a compound bow while the bow is stored in a partially relaxed condition without a bowstring installed.

It is, therefore, a primary purpose of the present invention to provide an improved tension-relieving and bowstring replacing device for a compound bow.

It is another purpose of the present invention to provide a bowstring changing device which is easily installed on a compound bow, yet securely holds the cables of the compound bow during its use.

It is a further purpose of the present invention to provide a device which may be used to change bowstrings or allow storage of the compound bow without a bowstring installed, and yet allow the bow to be restrung without the necessity of retuning.

It is a further purpose of the present invention to provide a device which is easily adjustable for use with compound bows having different lengths of bowstrings and which is easily portable for use in the field.

The tension-relieving and bowstring replacing device of the present invention comprises a pair of forked connectors and a pair of slotted retainers, one connector and one retainer being located in spaced relationship to one another at each end of a length of interconnected segments of steel cable arranged in a foldable linking arrangement. A lever-operated tensioner device is used in the device of the invention to easily relieve tension from the bowstring to facilitate bowstring replacement. A turnbuckle included in the linking arrangement is equipped with a hook, and eyes are provided in the interconnected length of cable, permitting the overall operative length of the device to be adjusted, making the device useable with bows having a wide range of different bowstring lengths.

The forked connector at each end of the bowstring changing device of the invention includes a socket which engages the bowstring fastener attached to one of the tensioned cables of the compound bow, while the slotted retainer has a slot which is oriented at an obtuse angle to the slot in the connector in the forked connector, preventing inadvertent dislocation of the forked connector from its proper position on the bowstring fastener of each cable of the compound bow.

The lever-operated tensioner comprises a lever which is pivoted to rotate about one of its ends. One part of the linking arrangement attaches to that pivoted end, and the other part of the linking arrangement is attached to a connecting point on the lever which is spaced apart from the pivoted end so that pivoting the lever 180 degrees shortens or lengthens the device of the invention by twice the separation between the connecting point and the pivot point.

The tension-relieving and bowstring replacing device of the invention is installed on the compound bow with the lever-operated tensioner in its extended position, giving ample slack for installation of the connector and retainer on the cable end at each end of the bow when the bowstring is installed and tight. After installation of the device the lever-operated tensioner is contracted by moving the lever from the extended position to a folded position. This pulls the ends of the cables of the bow toward one another, and is accomplished with considerably less force than is required to slacken the bowstring using either the Carlson or the Smith device. Once tension has been applied using the lever-operated tensioner the tensioning device of the invention is securely held in its contracted condition by a bail which holds the lever in the folded position, leaving both hands of the user of the device free to manipulate the bowstring without fear of loss of control of the bow.

If the compound bow is to be stored for a period of time, the bowstring can be removed and the lever-operated tensioner may be relaxed. With the device of the invention properly adjusted for the length of the bow, the limbs of the bow will be able to straighten nearly completely, yet some tension will be retained in the cables. With the bow stored while the tension-relieving and string replacing device of the invention is so installed the limbs are less subject to tendency to acquire a bow-weakening deformation or "set", and yet the compound bow will not need to be retuned upon replacement of the bowstring.

It is an important feature of the present invention that it includes forked connectors and slotted cable retainers which prevent the device from inadvertently being dislodged from the cable ends of the compound bow while it is installed.

It is a further important feature of the present invention that it includes a lever-operated tensioner for ease of operation.

It is a further feature of the present invention that it includes a turnbuckle for adjustment of the length of the device for use with compound bows having bowstrings of different lengths.

It is yet a further feature of the present invention that it includes a plurality of attachment points for the turnbuckle, giving additional adjustability of effective length of the device.

It is an additional feature of the present invention that it has linked construction enabling the device to be folded for being easily carried in one's pocket for use while hunting.

It is an important advantage of the present invention that it allows replacement of the bowstring of a compound bow to be accomplished more easily and safely than has previously been possible.

The foregoing objectives, features and advantages of the present invention will be more readily understood upon consideration of the following detailed description of the invention taken in conjunction with the accompanying drawings.

BRIEF DESCRIPTION OF THE DRAWINGS

FIG. 1 is a side view of an exemplary tension-relieving and bowstring replacing device embodying the present invention, installed on a compound bow whose bowstring is installed.

FIG. 2 is a side view of the tension-relieving and bowstring replacing device shown in FIG. 1, at an enlarged scale.

FIG. 3 is a side view of one of the forked connectors of the device shown in FIG. 2, taken along line 3—3.

FIG. 4 is a view of one of the slotted cable retainers of the device shown in FIG. 2, taken along line 4—4.

FIG. 5 is a sectional view of a portion of the lever-operated tensioner of the device shown in FIG. 2, taken along line 5—5.

FIG. 6 is a side view of the tension-relieving and bowstring replacing device shown in FIG. 1, installed on a compound bow, with the device in the contracted condition.

FIG. 7 is a view of the tension-relieving and bowstring replacing device of FIG. 1, installed on a compound bow, with the device in the extended condition.

DETAILED DESCRIPTION OF THE PREFERRED EMBODIMENTS

Figure 8:
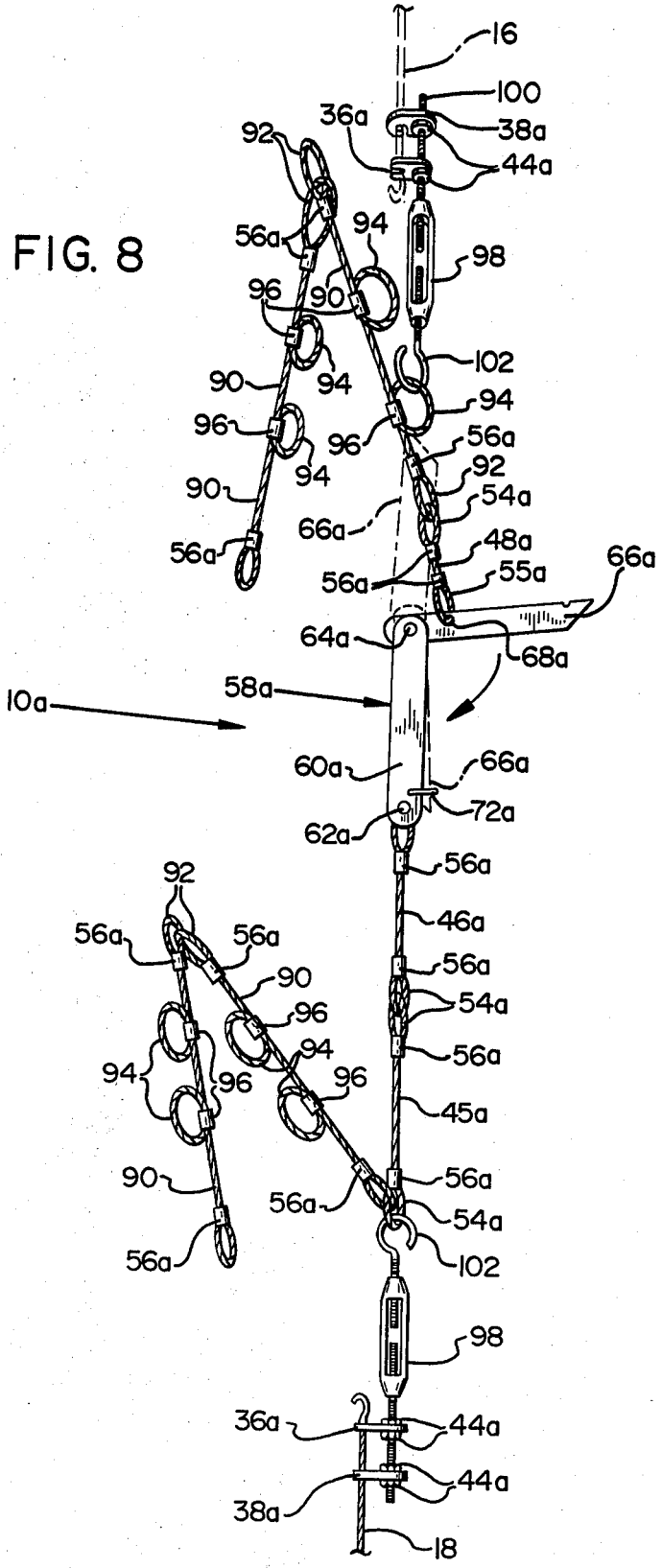
FIG. 8 is a view of an alternative embodiment of the tension-relieving and bowstring replacing device of the invention.

Referring now to FIG. 1 of the drawings, an exemplary tension-relieving and bowstring replacing device 10 which embodies the present invention is mounted on a compound bow 12. A bowstring 14 is tightly stretched between a pair of bowstring fasteners 16 of the bow 12. One bowstring fastener 16 is attached to a first end of each of a pair of tensioned cables 18 which are rove through a pair of eccentric pulleys 20, a pair of intermediate pulleys 22, and a pair of inner pulleys 24. The other end of each tensioned cable 18 is secured to an anchor point such as a spool 26 about which a portion of the cable 18 is wound in order to adjust its effective length.

The compound bow also comprises a frame 28, to which a pair of limbs, an upper limb 30 and a lower limb 32, are attached. Adjustment screws 34 permit the angular position, with respect to the bow frame 28, of each limb 30 or 32 to be individually adjusted so that the limb provides the proper amount of force to an arrow when it is shot from the bow.

Referring now also to FIGS. 2–5, it may be seen that at each end of the device 10 of the invention a forked connector 36 is located in spaced relationship to a slotted cable retainer 38, both of which are mounted on one of a pair of threaded rods 40 and 41 which include eyes 42 and 43, respectively. Jam nuts 44 hold the forked connectors 36 and slotted retainers 38 securely in position. Preferably the forked connector 36 is spaced about one inch from the eye 42 or 43, and the slotted retainer 38 is spaced about $\frac{7}{8}$ inch to $1\frac{1}{4}$ inch further from the eye 42 or 43. The threaded rods 40 and 41 in a preferred embodiment are connected to one another by lengths 45, 46 and 48 of steel cable, and interconnecting circular links 50 and 52. Each length of cable includes a loop 54 or 55 at each end, each loop being secured, for example, by a crimped or swaged collar 56. A lever-operated tensioner 58 is located between the lengths 46 and 48 of cable.

The lever-operated tensioner 58 includes a pair of similar elongate side plates 60 fastened to one another in apart-spaced parallel relationship such as by a pair of bolts 62 and 64 located near respective opposite ends of the elongate side plates 60. An elongate lever 66 extends between the elongate side plates 60 and is pivoted about the bolt 64. The lever 66 may then rotate to extend in a direction opposite to the elongate side plates 60 or to fit between and parallel to the elongate side plates 60. The loop 55 in one end of the length of cable 48 is engaged through a hole 68 provided in the lever 66. The loop 55 is preferably longer than the distance between the hole 68 and the bolt 64, in order to minimize interference between the loop 55 and the lever 66. A bail 72 is pivotally mounted to the elongate side plates 60 to hold the lever 66 when it is folded to the contracted position of the tensioner 58, as shown in broken line in FIG. 2.

A length adjusting device, for example a turnbuckle 74, is used to connect the link 52 to the eye 43 of the threaded rod 41. This allows the overall length of the tension-relieving and bowstring replacing device 10 to be adjusted for use of the device 10 with compound bows equipped with bowstrings 14 of various lengths.

Referring now to FIG. 3, one of the forked connectors 36 is seen to comprise a rectangular plate 75 which may be preferably made of aluminum, because of its light weight and high strength, although other materials may also be used. A slot 76 extends perpendicularly between the major faces of the rectangular plate, extending from a forked end 77 of the connector 36 toward the other end 78 of the connector. The slot 76 is preferably barely wide enough to allow the forked end 77 to slide over one of the cables 18. A hollowed-out socket 79 defined in one face of the plate 75 is centered around the inner end of the slot 76 to receive the fastener 16 attached to the cable 18 to which the connector is attached. A hole 80, located near the other end 78 of the plate 75, is also perpendicular to the major faces of the plate 75 and includes interior threads to receive one of the threaded rods 40 and 41.

Referring now to FIG. 4, one of the slotted cable retainers 38 is seen to comprise a generally rectangular plate 81 of material which may be similar to the plates 75 of the forked connectors 36. A slot 82 extends between the faces of the plate 81, from a point approximately midway long one of the longer edges 83 of the slotted retainer, at an acute angle to the edge of the slotted retainer, toward a position midway between the two longer edges 83 and near an end 84. A retainer slot detent groove 85 of the slot 82 extends further toward the end 84, parallel to the longer edges 83 of the retainer 38. A hole 86 extends perpendicularly through the plate 81 near the other end 87 of the plate 81 and serves a function similar to that of the hole 80 in the forked connectors 36.

Referring now to FIG. 5, showing a detail of the lever-operated tensioner 58, the elongate side plates 60 of the tensioner 58 are seen to be held apart by a spacer 88 which provides clearance for the lever 66 and for attachment of the loop 54 of the cable length 46 about the outside of the spacer 88.

An alternative embodiment **10*a* of the device of the invention is shown in FIG. 8, where it may be seen that two special lengths 90 of cable are provided at each end of the device 10*a*. These special lengths 90 of cable include not only interconnected eyes 92 at their ends, but additional eyes 94 intermediate the ends of each length 90 of cable. The additional eyes 94 may be formed preferably as loops in the lengths 90 of cable, secured by additional crimped or swaged metal collars 96**.

A turnbuckle 98 is provided at each end of the device. One threaded rod 100 of each turnbuckle 98 is equipped with a connector **36*a* and a cable retainer 38*a*, secured by jam nuts 44*a*. As in the previously described embodiment of the invention, a hook 102 having sufficient clearance to engage one of the eyes 96 is provided on the other threaded rod 104 of each turnbuckle 98, allowing each turnbuckle to be selectively connected to one of the eyes 96 or 54*a* to provide the required effective length of the device 10*a*, to fit a compound bow using any of a wide variety of lengths of bowstring. A lever-operated tensioner 58*a*, similar to the tensioner 58 of the previously described device 10, includes side plates 60*a*, bolts 62*a* and 64*a*, an elongate lever 66*a*, a hole 68*a*, and a bail 72*a*. The tensioner 58*a* interconnects the cable lengths 46*a* and 48*a*, permitting extension and contraction of the device 10*a* similar to that of the device 10**.

The tension-relieving device 10 is used as illustrated in FIGS. 1, 6 and 7. When it appears that the bowstring of a compound bow needs replacement, with the bowstring 14 installed on the compound bow 12, the lever-operated tensioner 58 is placed in the extended position, as shown in FIG. 1, and the slot 76 of one of the forked connectors 36 is placed over one of the cables 18, with the socket 79 facing toward the fastener 16. The cable 18 is then also pushed into the slot 82 of the slotted cable retainer 38 on the same threaded rod 40 or 41, until the cable 18 is within the retainer slot detent groove 85. Similarly, the other slotted connector 36 and slotted cable retainer 38 are fastened about the other cable 18 of the compound bow 12. The slotted connector is slid along each cable 18 until the bowstring fastener 16 of the cable fits within the socket 79 of the forked connector 36.

With the bowstring fastener 16 in the socket 79 and the slotted cable retainer 38 attached to the cable 18, the device 10 of the invention is securely fastened to each of the cables 18, since the socket 79 and the retainer slot detent groove 85 are aligned with one another in a line parallel to the respective rod 40 or 41. The detent groove then acts as a fulcrum, and tension on the rod 40 or 41 urges the associated forked connector 36 toward the respective cable 18. The retainer slot detent groove 85, since it is offset from the slot 82, makes it necessary to move the cable first in one direction and then in an offset direction to remove the slotted cable retainer 38 from the cable 18, preventing the slotted retainer 38 from slipping from the cable 18.

To remove tension from the bowstring 14, the lever 66 is rotated with respect to the outside plates 60 to the position shown in FIG. 6, pulling the bowstring fasteners 16 toward one another. The bail 72 is then placed around the end of the lever 66 to prevent it from returning to the extended position. The mechanical advantage provided by the lever 66 allows the fasteners 16 to be pulled toward one another using only about $\frac{1}{4}$ of the force required to manually pull the cables 18 toward one another.

Once the lever 66 has been locked in the folded position by the bail 72, both hands are left free to safely remove the bowstring 14 from the bowstring fasteners 16, since the tension-relieving device 10 of the invention securely holds the cables 18. Once a new bowstring 14 has been installed on the bowstring fasteners 16 the bail 72 may be removed from the lever 66 and the lever 66 may be moved toward the extended position of the tensioner 58 to apply tension to the new bowstring 14, slackening the tension-relieving device 10. The device 10 may then be removed from the cables 18 by the reverse of the procedure used to attach it to the cables 18.

For storage of the compound bow during periods of non-use, it is desirable to remove the bowstring and relax the limbs 30 and 32 of the bow beyond the position (shown in broken line in FIG. 7) normally occupied by the limbs 30 and 32 when a bowstring 14 of the appropriate length is installed. This may be accomplished using the tension-relieving device 10 of the present invention by removing the bowstring from at least one of the bowstring fasteners 16. Thereafter the lever 66 is allowed to move to the fully extended position of the tension-relieving and bowstring changing device 10, as shown in FIG. 7. With the turnbuckle 74 properly adjusted, the change of length of the device 10 provided by moving the lever 66 throughout its range of motion will be sufficient to provide slack enough for replacement of a bowstring 14, yet substantially relax the tension in the bow limbs 30 and 32 when the lever 66 is allowed to assume the extended position after removal of the bowstring 14 from one of the bowstring fasteners 16. The tension-relieving device 10 will then also retain at least a small amount of tension in the cables 18 although the limbs 30 and 32 of the compound bow 12 have been relaxed considerably. The compound bow 12 can then be stored over long periods without the limbs 30 and 32 acquiring a significant "set", yet without requiring the bow to be retuned upon installation of bowstring 14 at the end of a period of storage.

Operation of the bowstring changing and tension-relieving device **10*a* depicted in FIG. 8, is similar, except that this embodiment has an added capability for use with bows using widely differing lengths of bowstrings 14. The hook 102 of each turnbuckle 98 is fastened into an appropriate eye 94 or 54*a* and the turnbuckles 98 are adjusted so that moving the lever 66*a* of the tensioner 58*a* to the contracted position shown in broken line in FIG. 8 slackens the bowstring 14 as is the case using the first described device 10 shown in FIG. 6. This permits removal of the bowstring 14 for replacement, and allows partial relaxation of the tension in the bow 12, without disturbance of cable adjustment. Partial relaxation of the bow 12 is also accomplished in the same fashion as with the previously described device 10 by relaxing the tensioner 58*a* to the extended condition as shown in FIG. 8** in dot and dash line.

It will also be appreciated that the linked construction of either above-described embodiment of the device, incorporating the lengths of cable 45, 46 and 48, and links 50 and 52, or the interconnected lengths **45*a*, 46*a*, 48*a*, and 90, of cable, permits the device to be folded to a length which is substantially less than the length of the bowstring 14 of a compound bow 12**. The device is thus reduced to a form in which it is easily carried in one's pocket.

The terms and expressions which have been employed in the foregoing specification are used therein as terms of description and not of limitation, and there is no intention, in the use of such terms and expressions, of excluding equivalents of the features shown and described or portions thereof; it being recognized that the scope of the invention is defined and limited only by the claims which follow.

What is claimed is:

1. For use with a compound bow of the type having the bowstring normally stretched between two oppositely biased tensioned cables, opposite ends of said bowstring being releasably coupled to said cables by bowstring fasteners fixed to said cables, a device to aid in replacement of the bowstring and permit storage of said compound bow with said bowstring removed, said device comprising:

(a) a pair of connectors each defining socket means for engaging a respective one of said bowstring fasteners;

(b) slotted cable retainer means associated with each of said connectors, for retaining the respective one of said connectors in engagement with the respective one of said bowstring fasteners;

(c) elongate linking means disposed between said pair of connectors for linking said connectors to each other;

(d) a lever-operated tensioner included in said elongate linking means, said lever-operated tensioner having an extended position and a contracted position, the length of said linking means being such that when said lever-operated tensioner is in its extended position said connectors may be separated farther from one another than the maximum distance between the farthest separated portions of said bowstring fasteners when said bowstring is connected therebetween and that when said lever-operated tensioner is in said contracted position said connectors are closer to one another than said maximum distance, permitting removal and replacement of said bowstring.

2. The device of claim 1, said linking means including a pair of rods, a respective one of said connectors and a respective one of said slotted cable retainer means being mounted on each of said rods, with each slotted cable retainer means being located in a predetermined position relative to the respective connector.

3. The device of claim 2 wherein each of said connectors includes a connector slot located adjacent to said socket means, and wherein each of said slotted cable retainer means has retainer slot means defined therein for fitting around the respective one of said cables, said retainer slot means being oriented non-parallel to said connector slot of the respective connector with which said one of said slotted cable retainer means is associated.

4. The device of claim 3 wherein each of said slotted cable retainer means further defines detent means associated with said retainer slot means, for preventing said retainer means from slipping from said tensioned cable.

5. The device of claim 2 including respective threaded means associated with each of said rods for adjusting the location of each of said slotted cable retainer means relative to the respective one of said connectors.

6. The device of claim 2, wherein said elongate linking means includes a plurality of eye means, and said rods have hook means associated therewith, for detachably hooking each of said rods into one of said eye means, permitting adjustment of the effective length of said linking means and enabling use of said device with compound bows having bowstrings of different lengths.

7. The device of claim 1 wherein said elongate linking means includes turnbuckle means for adjusting the length of said elongate linking means and enabling use of said device with compound bows having bowstrings of different lengths.

8. The device of claim 1 wherein said device has a predetermined overall extended length, and wherein said elongate linking means comprises folding means for permitting said device to be folded to a folded length which is substantially less than said overall extended length.

9. The device of claim 1 where said lever-operated tensioner comprises bail means for preventing said lever-operated tensioner from inadvertently moving from said contracted position to said extended position.

10. The device of claim 6 wherein said elongate linking means comprises a plurality of lengths of cable, at least one of said plurality of lengths of cable including a plurality of eyes fixedly located at different positions along the length thereof, and wherein said turnbuckle means includes hook means for detachably connecting said turnbuckle means to any selected one of said eye means, thereby permitting adjustment of the effective length of said linking means.

* * * * *

UNITED STATES PATENT AND TRADEMARK OFFICE

CERTIFICATE OF CORRECTION

PATENT NO. : 4,291,452

DATED : September 29, 1981

INVENTOR(S) : Archie E. Whitman, Sr.
and Donald D. W. Lathrop

It is certified that error appears in the above-identified patent and that said Letters Patent are hereby corrected as shown below:

On the cover sheet, change the name of the second inventor from "Lathrops" to read --Lathrop--.

Signed and Sealed this

First Day of June 1982

[SEAL]

Attest:

GERALD J. MOSSINGHOFF

Attesting Officer

Commissioner of Patents and Trademarks